US006045168A

United States Patent [19]

Johnson et al.

[11] Patent Number: 6,045,168

[45] Date of Patent: Apr. 4, 2000

[54] DOOR LATCH WITH IMPROVED DOUBLE LOCK

[75] Inventors: Joseph Michael Johnson, Huntington Woods; Joseph D. Cranston, Troy, both of Mich.

[73] Assignee: General Motors Corporation, Detroit, Mich.

[21] Appl. No.: 09/170,823

[22] Filed: Oct. 13, 1998

[51] Int. Cl.[7] ..... E05C 3/06

[52] U.S. Cl. ..... 292/216; 292/DIG. 23; 292/DIG. 27

[58] Field of Search ..... 292/216, DIG. 23, 292/DIG. 27, 336.3, 169.11, DIG. 61; 70/149

[56] References Cited

U.S. PATENT DOCUMENTS

| | | | |
|---|---|---|---|
| 4,342,209 | 8/1982 | Kleefeldt | 70/264 |
| 4,756,563 | 7/1988 | Garwood et al. | 292/216 |
| 5,054,827 | 10/1991 | Konchan et al. | 292/216 |
| 5,092,638 | 3/1992 | Mizuki | 292/216 |
| 5,308,128 | 5/1994 | Portelli et al. | 292/216 |
| 5,438,555 | 8/1995 | Ikeda | 70/279 |
| 5,474,338 | 12/1995 | Buscher | 292/201 |
| 5,538,298 | 7/1996 | Ikeda | 292/201 |
| 5,577,583 | 11/1996 | O'Donnell | 192/79 |
| 5,584,515 | 12/1996 | Silye | 292/201 |
| 5,653,484 | 8/1997 | Brackmann et al. | 292/216 |
| 5,666,834 | 9/1997 | Inoue | 70/237 |
| 5,899,508 | 5/1999 | Cetnar et al. | 292/216 |

*Primary Examiner*—B. Dayoan
*Assistant Examiner*—Clifford B Vaterlaus
*Attorney, Agent, or Firm*—Kathryn A. Marra

[57] ABSTRACT

A vehicle door latch mechanism (10) having an improved double lock assembly (34). The present double lock assembly (34) is disposed between the latch handle assembly (30) and the latching assembly (26). In the un-double locked configuration, the double lock (34) allows motion transfer from the latch handle assembly (30) to the latching assembly (26) by extending the secondary intermittent member (36). In the double locked configuration, the double lock (34) retracts the secondary intermittent member (36) to prevent motion transfer between the latch handle assembly (30) and the latching assembly (26), preventing any unlatching of the door (12) even if the lock assembly (32) is in the unlocked configuration.

12 Claims, 18 Drawing Sheets

DOOR LATCH WITH IMPROVED DOUBLE LOCK

TECHNICAL FIELD

The invention relates to a vehicle door latch, and more particularly to a vehicle door latch having a double lock mechanism.

BACKGROUND OF THE INVENTION

Conventional door latches include a locking mechanism by which a latch can be locked to prevent unauthorized unlatching. The lock can be operated from inside the door with a sill button, or from outside the door with a key operated cylinder or similar mechanism.

The prior art has recognized that a person seeking unauthorized access into a vehicle without a key can break the window, reach inside, and operate the manual unlock button, thereby unlocking the door latch so that the door can be opened using either the outside door handle or the inside door handle. The prior art has recognized the advantage of a door lock operating system having what amounts to an additional lock to prevent a subsequent unlocking of the door lock via operation of the inside sill or locking button. Typically the lock is locked by an operation involving a remote control device or the key lock cylinder. Accordingly, once the occupant has left the vehicle and performed certain operations involving the remote control or an electrical switch on or near the key lock cylinder, the door cannot be opened later by breaking the window and reaching in to operate the manual locking button. This type of feature has come to be known as a "double locking" feature because it adds a second lock to the door latch mechanism.

The present invention provides a new and improved mechanism for performing the aforedescribed function of disabling the inside door locking button.

SUMMARY OF THE INVENTION AND ADVANTAGES

The present invention is a door latch mechanism having a novel double lock configuration. A latching assembly mounts in an enclosure and moves from an unlatched configuration to a latched configuration. An intermittent member engages this latching assembly and moves from a rest position to an unlatched position in which the intermittent member moves the latching assembly into the unlatched configuration. A latch handle assembly fits adjacent the intermittent member. It moves from a rest position to an unlatching position to engage the intermittent member and move the intermittent member to the unlatched position. A lock assembly is disposed in the enclosure, and it engages the intermittent member. The lock assembly moves between a locked position and an unlocked position. In the unlocked position, the lock assembly moves the intermittent member so that the intermittent member engages the latch handle assembly when the latch handle assembly moves toward the unlatching position. In the locked position, the lock assembly isolates the intermittent member from the latch handle assembly. The mechanism further includes a double lock assembly having a secondary intermittent member connected to the latch handle assembly. The secondary intermittent member moves between a double locked position and an un-double locked position. In the un-double locked position, the secondary intermittent member extends outwardly from the latch handle assembly to allow motion transfer between the latch handle assembly and the intermittent member. In the double locked position, the secondary intermittent member retracts to prohibit any motion transfer between the latch handle assembly and the intermittent member. The double lock assembly includes a switch disposed adjacent the secondary intermittent member. The switch moves between an unswitched position and a switched position wherein the switch biases the secondary intermittent member into the double locked position. The double lock assembly further includes a spring disposed between the switch and the secondary intermittent member biasing the secondary intermittent member into the un-double locked position when the switch moves into the unswitched position, and into the double-locked position when the switch moves into the switched position.

The present invention improves on the double lock art because it adds convenience for the operators. For example, the latch can be double locked before it is locked. No special sequencing need be followed. Also, the latch can be un-double locked in any latch condition. This is significant in the case of the impatient passenger—one who pulls the outside latch handle before the latch has been unlocked. With the present invention, such an impatient passenger will not interrupt the un-double locking operation.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

The present invention is a door latch mechanism having a novel double lock configuration. As mentioned above, a double lock may be conceptualized as a second lock that prevents unauthorized unlocking of the door latch. Referring to the Figures wherein like numerals indicate like or corresponding parts throughout the several views, the door latch mechanism is generally shown at 10.

Figure 1:
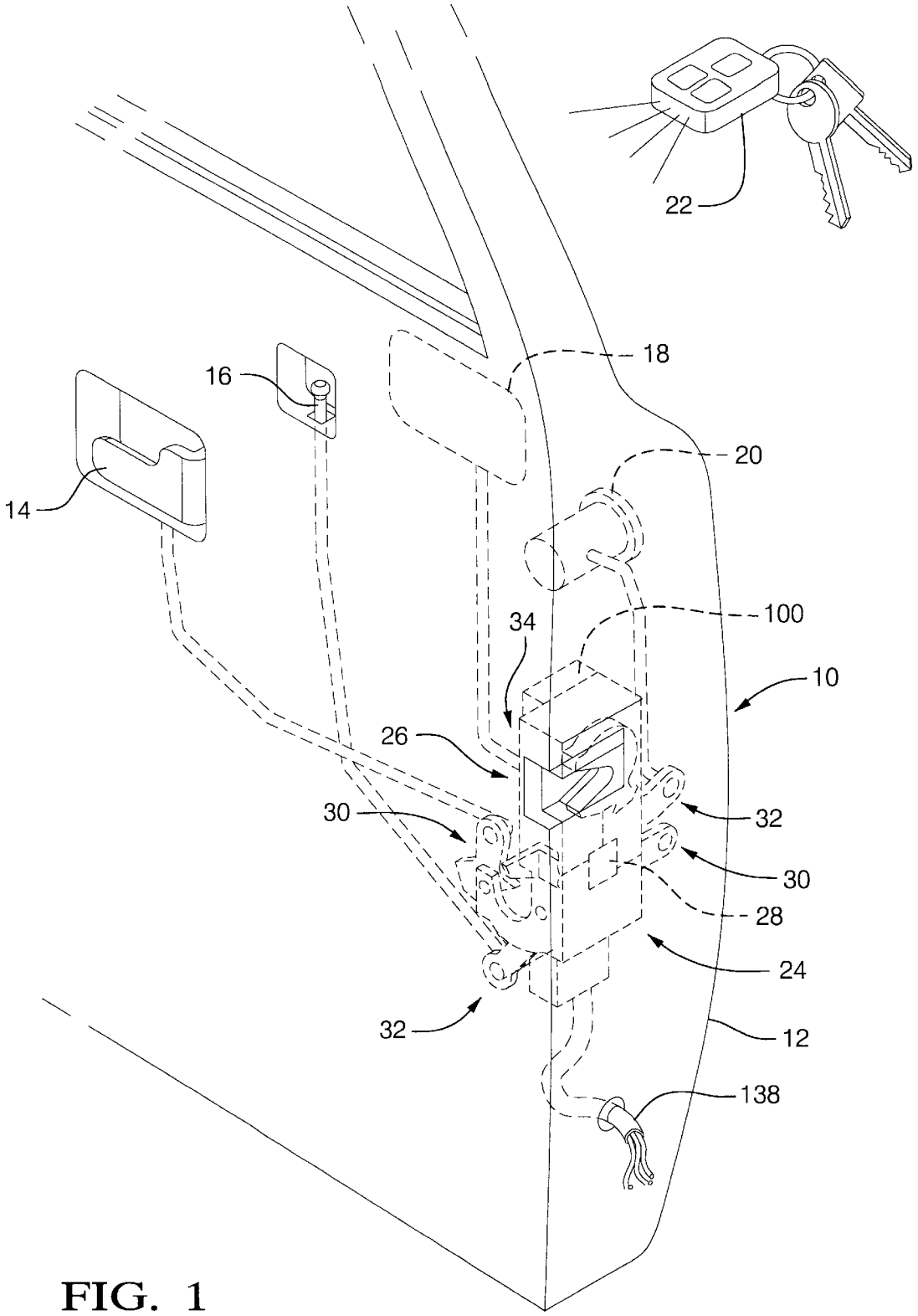
FIG. 1 is a perspective view of a vehicle door showing the door a latch in its environment.

FIG. 1 shows the subject door latch mechanism 10 in its intended environment on a vehicle door 12. The door 12 includes an inner side having an inside latch handle 14 and an inside lock button 16 sometimes referred to as a sill button. The door also has an outer side having an outside latch handle 18 and a key lock cylinder 20. These elements all connect to the latch 10 roughly in the manner shown. The connections may be strictly mechanical or electromechanical in nature. The latch mechanism 10 may also involve some sort of remote control device such as the key fob 22.

Broadly construed, the invention involves the following basic elements or components. First is an enclosure generally shown at 24 that houses the other components. A latching assembly generally shown at 26 mounts in the enclosure 24 and moves from an unlatched configuration to a latched configuration. An unlatching arm—herein referred to as an intermittent member 28—engages the latching assembly 26. The intermittent member 28 moves from a rest position to an unlatched position in which the intermittent member 28 moves the latching assembly 26 into the unlatched configuration. A latch handle assembly generally shown at 30 fits adjacent the intermittent member 28. It moves from a rest position to an unlatching position to engage the intermittent member 28 and move the intermittent member to the unlatched position. A lock assembly generally shown at 32 is disposed in the enclosure 24, and it engages the intermittent member 28. The lock assembly 32 moves between a locked position and an unlocked position. In the unlocked position, the lock assembly 32 moves the intermittent member 28 so that the intermittent member engages the latch handle assembly 30 when the latch handle assembly moves toward the unlatching position. In the locked position, the lock assembly 32 isolates the intermittent member 28 from the latch handle assembly 30. The mechanism further includes a double lock assembly generally shown at 34 having a secondary intermittent member 36 connected to the latch handle assembly 30. The secondary intermittent member 36 moves between a double locked position and an un-double locked position. In the un-double locked position, the secondary intermittent member 36 extends outwardly from the latch handle assembly 30 to allow motion transfer between the latch handle assembly and the intermittent member 28. In the double locked position, the secondary intermittent member 36 retracts to prohibit any motion transfer between the latch handle assembly 30 and the intermittent member 28. The double lock assembly 34 includes a switch 38 disposed adjacent the secondary intermittent member 36. The switch 38 moves between an unswitched position and a switched position wherein the switch biases the secondary intermittent member 36 into the double locked position. The double lock assembly 34 further includes a spring 40 disposed between the switch 38 and the secondary intermittent member 36 biasing the secondary intermittent member into the un-double locked position when the switch 38 moves into the unswitched position, and into the double-locked position when the switch 38 moves into the switched position.

Apart from the double lock feature, the door latch mechanism 10 has the same basic arrangement as the vehicle door latches disclosed in U.S. Pat. No. 4,756,563 granted to Stephen L. Garwood and Jeffrey Konchan, Jul. 12, 1988 for a vehicle door latch; and U.S. Pat. No. 5,054,827 granted to Jeffrey L. Konchan and Jiri Paulik, Oct. 8, 1991 for a vehicle door latch, both of which are hereby incorporated by reference into this patent specification. The improved double lock feature can be used in connection with a variety of door latches—as persons of skill in the art can readily appreciate. In the preferred case, the improved double lock feature works with door latches of the type mentioned above—U.S. Pat. Nos. 4,756,563; 5,054,827; and later related door latch patents also assigned to General Motors.

Enclosure

The enclosure 24 mentioned above comprises a plastic housing 42, a metal face-plate 44 and a metal back plate 46. The plastic housing 42 and the metal back plate 46 are held together by three flanged, internally threaded bushings 48, 50, 52 that are inserted into three holes in the plastic housing 42, then through three aligned holes in the back plate 46 and then flanged over the back plate 46. The metal face plate 44 has three bolt holes that are aligned with the bushings 48, 50, 52 when the metal face plate is attached to the plastic housing 42 by a screw. The metal face plate 44 and the metal back plate 46 have lower portions below the plastic housing 42 that are held together by a flanged stud 54 that has projecting pins at each end that are inserted in holes in the plates and peened or headed over.

Latching Assembly

The latching assembly is generally indicated throughout the FIGS. at 26. The exact configuration of the latching assembly 26 is not critical to the invention; and so several different configurations are possible for use in connection with the invention. For purposes of this invention, the latching assembly 26 need only have parts that can latch the vehicle door 12 when it closes and engages a striker 27 on the door frame; and unlatch when the intermittent member 28 moves to the unlatched position.

Figure 2:
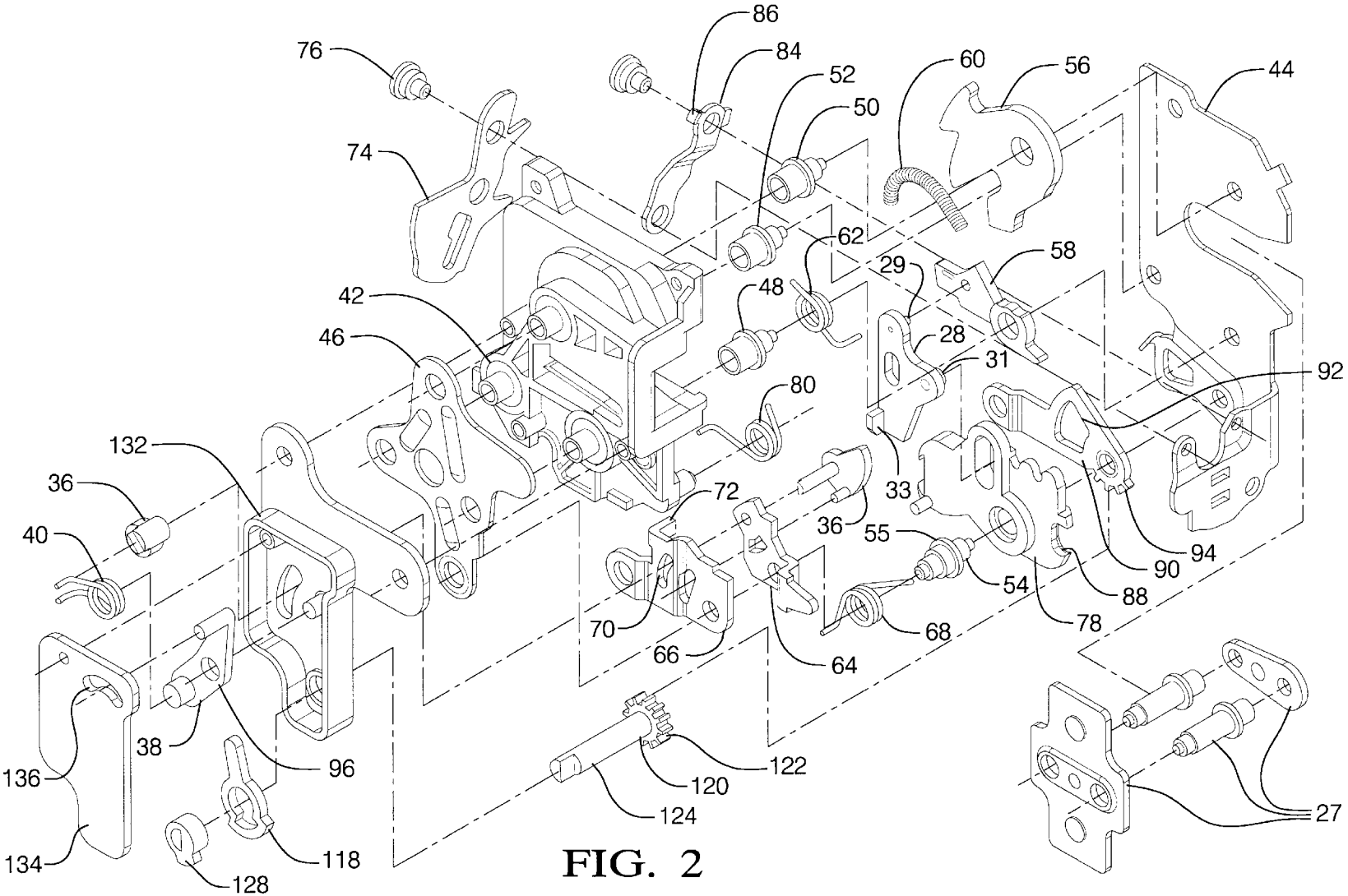
FIG. 2 is an exploded view of the present door latch mechanism having the double lock feature.

The parts of one typical door latching assembly are shown in FIG. 2. These parts are discussed in detail in the aforementioned U.S. Pat. Nos. 4,756,563 and 5,054,827. The parts include a fork bolt lever 56 and a cooperating detent lever 58 that are pivotally mounted on bushings 50 and 48, respectively, and located in a chamber of the plastic housing behind the metal face plate 44. An elongated coil spring 60 is disposed in a curved slot in the plastic housing behind the fork bolt lever 56, and it engages a depending pin of the fork bolt lever 56 at one end. The detent lever 58 is biased counterclockwise into engagement with the fork bolt lever 56 by a coil spring 62 that surrounds the bushing 48 and that has one end engaging the plastic housing 42 and the other end engaging an ear of the detent lever 58. The intermittent member 28 includes pins 29, 31 connecting the intermittent member to the detent lever 58 and the lock assembly 32, respectively. The intermittent member also includes a projection 33.

The detent lever 58 engages the fork bolt lever 56 in its unlatched position, and engages and holds the fork bolt lever in either an intermediate or fill latched position against the bias of spring 60. The detent lever 58 will continue to hold the fork bolt lever 56 in the intermediate or full latched positions until the intermittent member 28 moves from its rest position to its unlatched position. When this happens, the intermittent member 28 pulls down on one end of the detent lever 58 against the force of the spring 62; and this releases the fork bolt lever 56. The spring 60 forces the fork bolt lever 56 back into the unlatched position, allowing the striker 27 member to pull out of the fork bolt 56.

Latch Handle Assembly

A latch handle assembly 30 operates adjacent the intermittent member 28. It moves from a rest position to an unlatching position to engage the intermittent member 28 and move the intermittent member to the unlatched position. The latch handle assembly 30 includes an inside latch handle sub-assembly and an outside latch handle sub-assembly.

The outside latch handle sub-assembly includes a transfer lever 64. The transfer lever 64 is journalled on a reduced diameter portion of the stud 54 spaced behind the flange 55. The transfer lever 64 supports the secondary intermittent member 36 of the double lock assembly 34 as shown in the FIGS. so that the intermittent member 28 is pulled down to the unlatched position when the transfer lever 64 is rotated counterclockwise as viewed in FIG. 4B, for example. The operation of the secondary intermittent member 36 will be discussed more fully below in the section dealing with the double lock assembly 34.

The outside latch handle sub-assembly further includes outside operating lever 66 and a coil return spring 68. The outside operating lever 66 is also journalled on the reduced diameter portion of the stud 54 behind the transfer lever 64. It is connected to the transfer lever 64 via the secondary intermittent member 36 and a lost motion connection 70 so that the outside operating lever 66 rotates the transfer lever 64 downwardly when it is rotated downwardly about the stud 54. The outside operating lever 66 is connected by suitable linkage for rotation by the outside latch handle 18, as shown in FIG. 1. For the purpose of illustrating the action of the secondary intermittent member 36, the outside operating lever 66 is not shown in FIGS. 3B–10B.

The coil return spring 68 is disposed around the stud 54 and located between the flange 55 and the transfer lever 64. One end of the coil spring 68 engages the bottom of transfer lever 64 and the other end engages the bottom of the plastic housing 42 above the transfer lever 64 so that the transfer lever and outside operating lever 66 are biased upwardly to a rest position where tab 72 engages the bottom of the plastic housing 42.

The inside latch handle sub-assembly generally includes the input element 74 that is pivotally mounted on the enclosure 24 with a pivot pin 76. The input element 74 is disposed adjacent the transfer lever 64 so that the input element 74 will transfer motion from the inside latch handle 14 to the transfer lever 64—as shown in FIG. 4B, for example.

The latch and latch handle assemblies operate as follows. When the door latch mechanism 10 is in an unlatched, unlocked and un-double locked condition, the fork bolt lever 56 is poised to receive the striker 27. The entering striker 27 engages and rotates the fork bolt lever 56 counterclockwise against the bias of spring 60 until the fork bolt lever is rotated to a latched position. The fork bolt lever 56 is held in a latched position by the detent lever 58. The aforementioned prior art patents discuss this operation in greater detail.

The vehicle door latch mechanism 10 unlatches by operating either the inside or the outside latch handles 14, 18 to pull the intermittent member 28 down from its rest position to the unlatched position. This happens through a chain of motion transfer beginning with one of the latch handles 14, 18 and ending with the secondary intermittent member 36, which, in the un-double locked position, extends from the transfer lever 64. When a person pulls on one of the latch handles 14, 18, the secondary intermittent member 36 pivots down and engages the projection 33 on the intermittent member 28 to pull it down in to the unlatched position. As the intermittent member 28 is pulled down, it rotates the detent lever 58 against the bias of spring 62 from the latched position to the unlatch position. The fork bolt lever 56 is then free to rotate counterclockwise under the bias of spring 60 from a latched position as the striker 27 is pulled out of the fork bolt lever 56 when the vehicle door 12 is opened.

Lock Assembly

The lock assembly 32 is a freewheeling-type lock assembly disposed in the enclosure 24. The lock assembly 32 engages the intermittent member 28. The lock assembly 32 moves between a locked position and an unlocked position. In the unlocked position, the lock assembly 32 moves the intermittent member 28 so that the intermittent member engages the latch handle assembly 30 when the latch handle assembly moves toward the unlatching position. In the locked position, the lock assembly 32 isolates the intermittent member 28 from the latch handle assembly by pushing it away from the latch handle assembly. This is the basic lock assembly already disclosed in the aforementioned prior art patents.

The lock assembly 32 comprises the locking lever 78 that is pivotally mounted on the stud 54 between the flange 55 and the metal face plate 44. The locking lever 78 is typically plastic. As indicated above, the locking lever 78 is also connected to the intermittent member 28 by a pin and slot arrangement that allows these two parts to translate motion and pivot with respect to each other.

The locking lever 78 pivots on the stud 54 between an unlocked position and a locked position. The locking lever 78 is held in the locked or unlocked position by a coil spring 80 that has one end mounted on the plastic housing 42 and the other end engaging the plastic locking lever 78.

The lock assembly 32 further comprises an inside lock operating lever 84 for pivoting the plastic locking lever 78 back and forth between the locked and unlocked positions. The inside lock operating lever 84 is pivotally mounted on the flange of the metal face plate 44 in front of the input element 74 for unlatching the door. The inside lock operating lever 84 is pivotally mounted with some appropriate fastener such as a flanged stud, screw, rivet, etc. The inside lock operating lever 84 includes a first tab 86 that engages in a slot 88 in one end of the plastic locking lever 78 so that the plastic locking lever is pivoted clockwise from the unlocked position shown in FIG. 4B to the locked position shown in FIG. 5B when the inside lock operating lever 84 is pivoted counterclockwise by an inside sill button or lock slide 16.

The lock assembly 32 further includes a key cylinder lever 90. The key cylinder lever 32 connects with the key cylinder 20 for the door 12. The key cylinder lever 90 also connects with a raised portion (not shown) of the locking lever 78 through a lost motion connection 92. As will be explained in more detail, the cylinder lever 90 also includes a plurality of gear teeth 94.

Figure 3A:
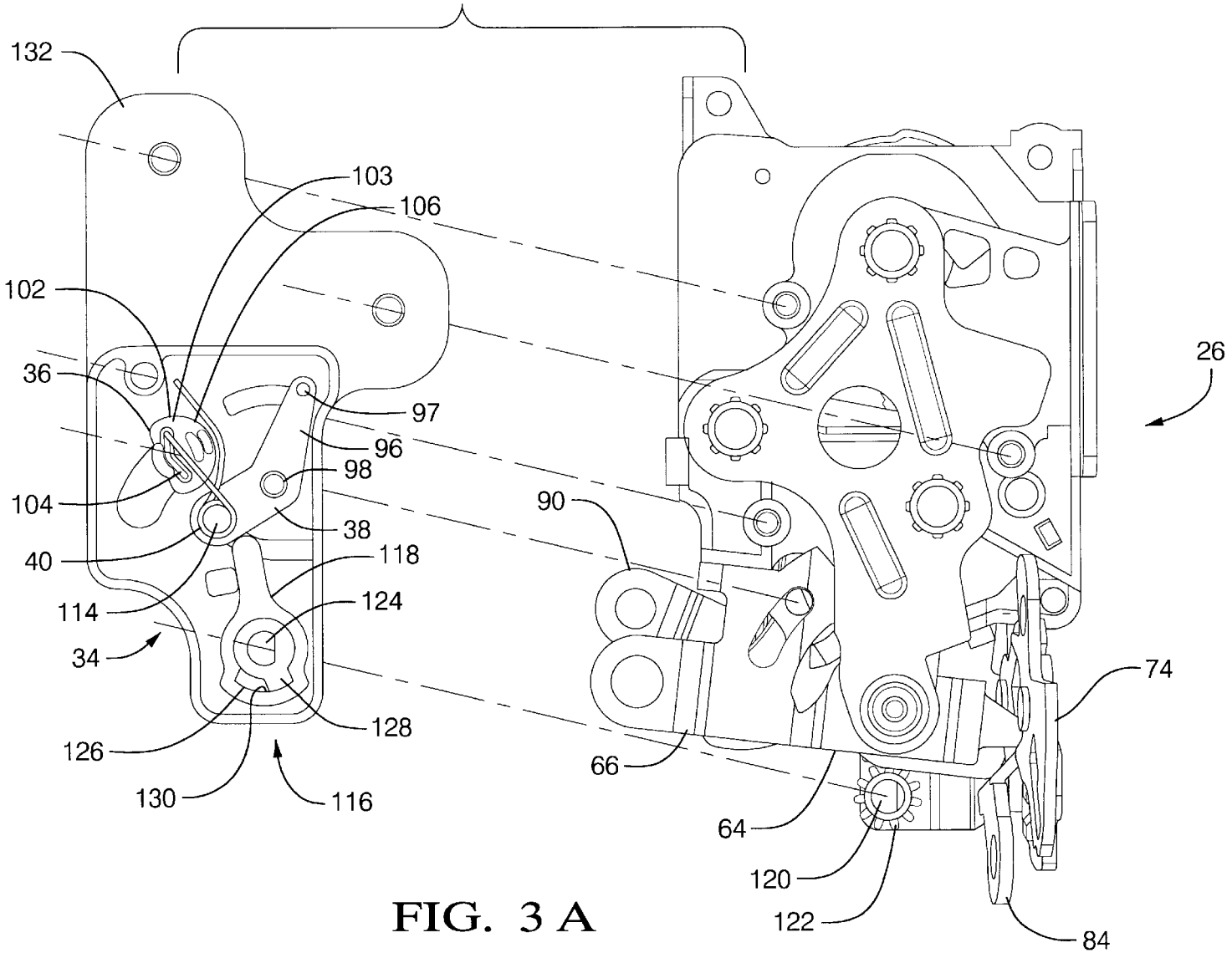
FIG. 3A is a rear view of the latch mechanism with a portion of the double lock assembly removed, and generally showing the mechanism in the latched, unlocked and un-double locked state.
Figure 3B:
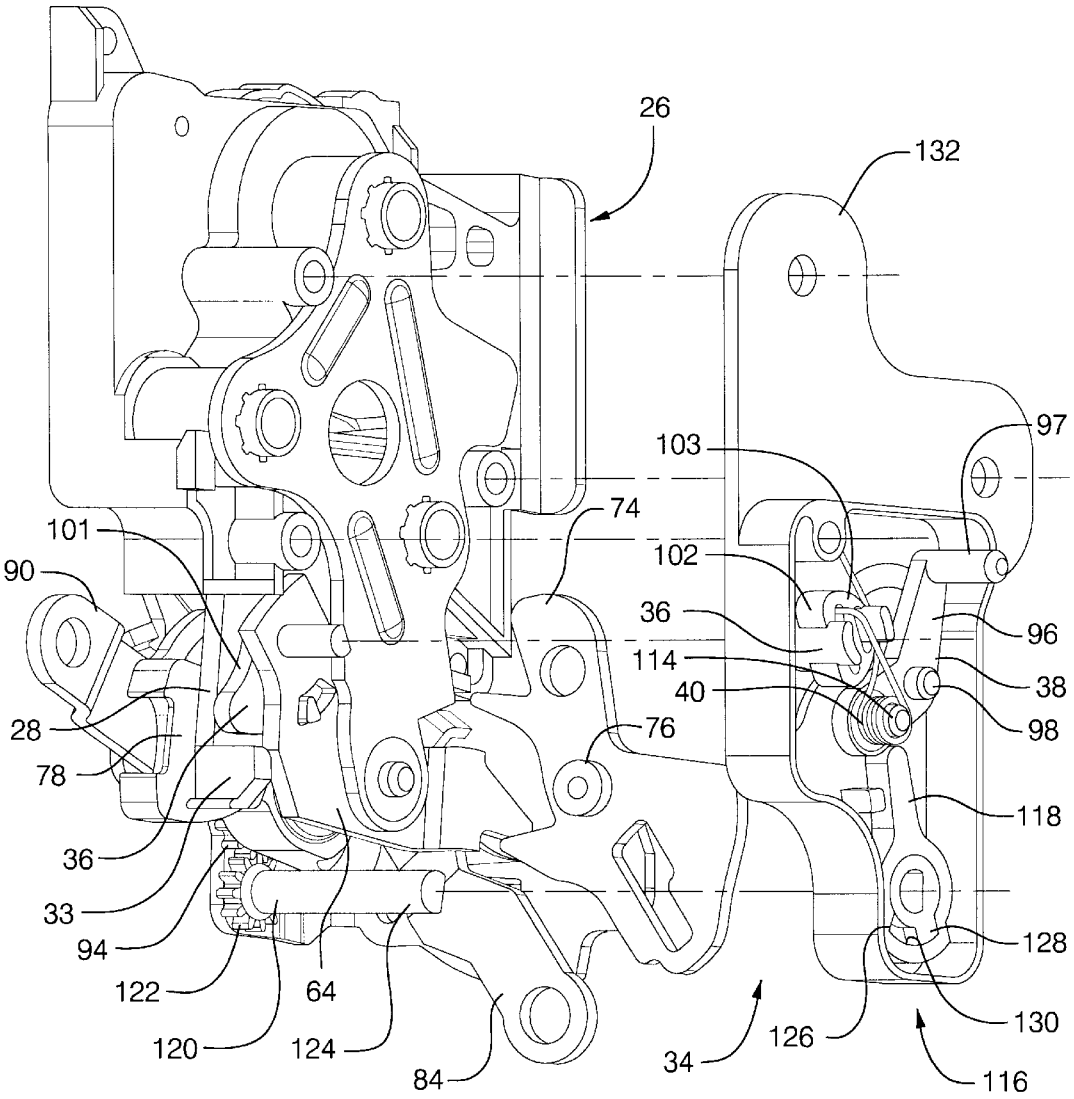
FIG. 3B is a rear perspective view of the latch mechanism with the portion of the double lock assembly removed, and generally showing the mechanism in the latched, unlocked and un-double locked state.

The lock assembly 32 operates as follows. When the vehicle door latch 10 is in a latched condition as shown in FIG. 3B, for example, the lock assembly 32 is actuated by rotating the locking lever 78 clockwise from the unlocked position shown in FIG. 3B to the locked position shown in FIG. 5B. As indicated above, this can be accomplished through rotation of the inside lock operating lever 84 by an inside sill button or lock slide 16. Similarly, the key cylinder 20 can be operated to pivot the key cylinder lever 90, which in turn will move the locking lever 78. Clockwise rotation of the locking lever 78 also rotates the intermittent member 28 as shown in FIGS. 3B and 5B. The intermittent member 28 is rotated from the unlocked position shown in FIG. 3B to the locked position shown in FIG. 5B, moving the projection 33 out from under the secondary intermittent member 36. Consequently, when the door handles 14, 18 are operated so as to rotate the transfer lever 64 to the unlatching position as shown in FIG. 6B, the secondary intermittent member 36 simply bypasses the projection 33 without transferring any motion to the intermittent member 28. In other words the transfer lever 64 simply free wheels so that operating of the door handles 14, 18 is ineffective. This is the manner in which the lock assembly 32 may interrupt motion transfer from the latch handles 14, 18.

The lock assembly 32 is unlocked simply by rotating the locking lever 78 back to the unlocked position shown in FIG. 3B where the projection 33 is beneath the secondary intermittent member 36 so that rotation of the transfer lever 64 pulls the intermittent member 28 and the detent lever 58 down to the unlatched position shown in FIG. 4B.

Double Lock Assembly

As discussed, the secondary intermittent member 36 mounts pivotally on the inside latch handle assembly—and specifically on the transfer lever 64. The secondary intermittent member 36 moves between a double locked position and an un-double locked position. In the un-double locked position (FIG. 3B for example), the secondary intermittent member 36 extends outwardly from the transfer lever 64 to allow motion transfer between the transfer lever 64 and the intermittent member 28. In the double locked position (FIG. 9B, for example), the secondary intermittent member 36 retracts to prohibit any motion transfer between the transfer lever 64 and the intermittent member 28.

The double lock assembly includes the switch 38 disposed adjacent the secondary intermittent member 36. The switch 38 controls the position of the secondary intermittent member 36. The switch 38 moves between an unswitched position and a switched position wherein the switch 38 biases the secondary intermittent member 36 into the double locked position. The switch 38 includes an elongated switch arm 96 that mounts on the enclosure 24 in pivoting fashion over a pin 98 that extends outwardly from the enclosure. The switch arm 96 includes an extension pin 97.

The switch 38 also includes an electromechanical actuator 100 for controlling the movement of the switch arm 96. The actuator 100 is shown schematically on FIG. 1. The exact details of the actuator 100 are not critical to the present invention; and many embodiments are possible. No single embodiment is preferred at the present time. The chief function of the electro-mechanical actuator 100 is to receive signals from the key fob 22 or similar control—perhaps even the key cylinder 20—and move the switch 38 accordingly. For example, as a person leaves her car, she can press a button on her key fob 22 to send a signal. The electro-mechanical actuator 100 can receive the signal and move the switch 38 into the double locked position.

The actuator 100 may further include a link 138 as shown in FIG. 1 to connect with a vehicle computer. For example, the computer may un-double lock the latch 10 when the vehicle is operating.

The double lock assembly 34 includes a spring 40 disposed between the switch 38 and the secondary intermittent member 36 biasing the secondary intermittent member into the un-double locked position when the switch 38 moves into the unswitched position. Also, the spring 40 can move or bias the secondary intermittent member 36 into the double-locked position when the switch 38 moves into the switched position.

The secondary intermittent member 36 includes an extendible end 101 disposed adjacent the transfer lever 64 and a remote spring end 102 disposed adjacent the spring 40. The spring end 102 has a top surface 103 defining an arcuate slot 104, and a side surface 106 adjacent the top surface.

The spring 40 includes a first arm and a second arm extending parallel to the first arm, the spring being coiled between the first and second arms. The coil of the spring 40 contacts the switch arm 96. As shown in FIG. 3A, for example, the switch arm 96 includes a spring mounting pin 114 over which the spring coil mounts.

The first arm of the spring 40 contacts the arcuate slot 104 in the spring end 102 of the secondary intermittent member 36. The first arm has a bent end that retains the first arm in position in the arcuate slot 104. The second arm of the spring 40 contacts the side surface 106. The side surface 106 is curved to facilitate easy movement of the second arm of the spring, which is also formed to have a radius or curve as shown in the FIGS.

The double lock assembly 34 further includes a manual override assembly generally shown at 116 disposed between the switch 38 and the key cylinder lever 90. The override 116 allows a person to un-double lock the latch mechanism 10 by turning a key in the key cylinder 20. The manual override 116 is movable between a neutral position and an override position in which the override assembly moves the switch 38 into the unswitched position The manual override assembly 116 includes an override lever 118 disposed adjacent the switch 38. The lever 118 is mounted in the pivoting manner shown. The manual override assembly 116 further includes an override gear 120 disposed between the key cylinder lever 90 and the override lever 118. The override gear 120 has teeth 122 disposed circumferentially around the gear. An elongated shaft 124 connects the gear teeth 122 of the gear and the override lever 118. The manual override assembly 116 further includes a lost motion connection 126 between the override gear 120 and the override lever 118. The lost motion connection 126 includes the tab 128 that is movable in the arcuate slot 130. The tab 128 will engage the override lever 118 and move the lever in certain circumstances. The manual override assembly 116 further includes the plurality of gear teeth 94 disposed on the key cylinder lever 90 in contact with the override gear 120.

The latch 10 further includes the switch enclosure 132 enclosing the switch 38, the spring 40, the spring end 102, and the override lever 118. The switch enclosure 132 includes the cover 134 having an arcuate slot 136 to provide clearance for the extension pin 97 of the switch arm 96. The extension pin 97 extends through the cover to interconnect with the electro-mechanical actuator 100.

Operation

The operation of the latch mechanism 10 will now be discussed in detail in connection with the drawings. In FIGS. 3A and 3B, the latch mechanism 10 is latched, unlocked and un-double locked. The switch 38 is in the unswitched position, and so the spring 40 biases the spring end 102 of the secondary intermittent member 36 clockwise. This pivots the extendible end 101 of the secondary intermittent member 36 out to where it can contact the projection 33 on the intermittent member 28 if and when the latch handle assembly 30—including the transfer lever 64—moves to the unlatching position. The lock assembly 32 is in the unlocked position, meaning that it has the intermittent member 28 positioned inwardly to the point where the secondary intermittent member 36 will contact it when the latch handle assembly 30 moves to the unlatching position.

Figure 4A:
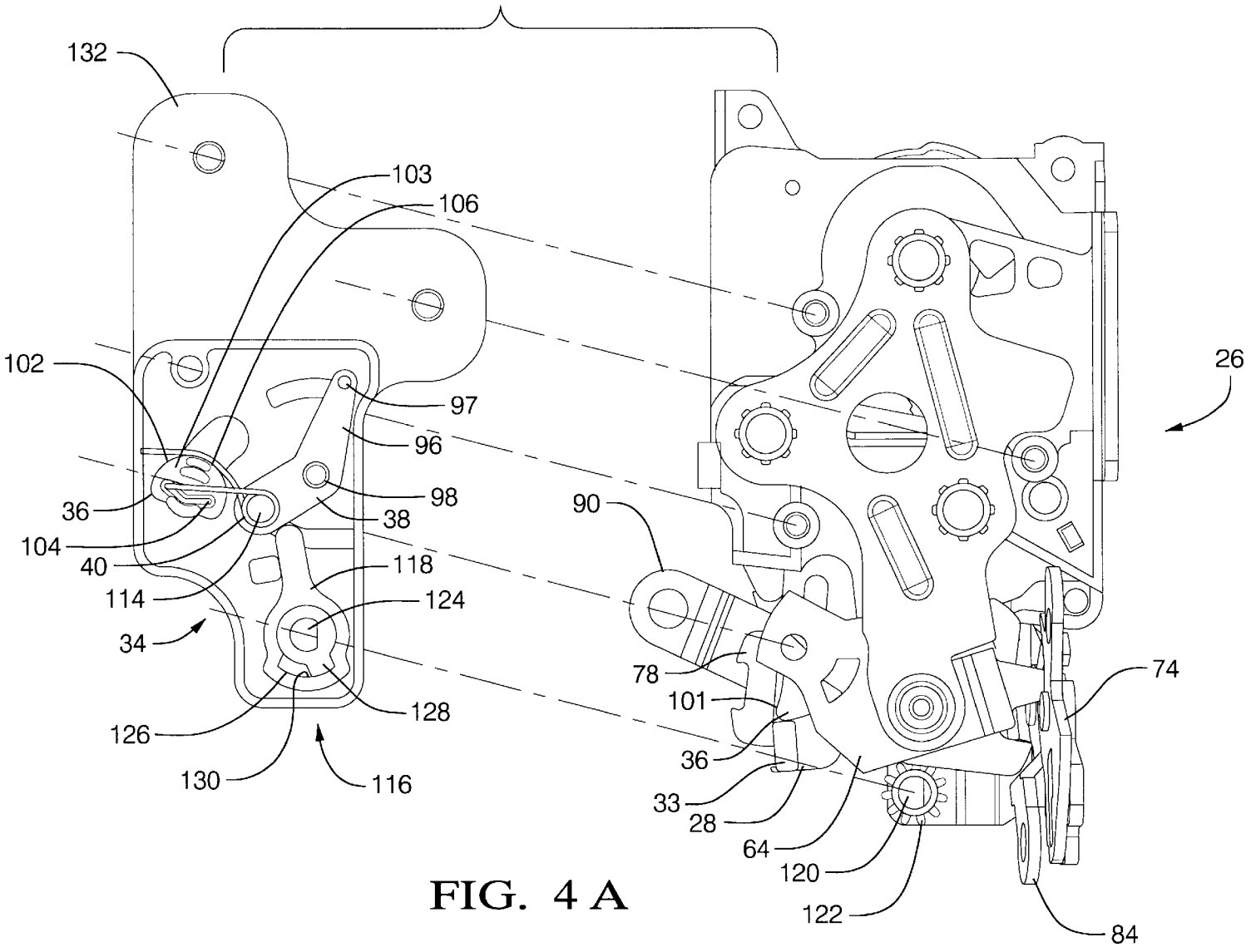
FIG. 4A is a rear view of the latch mechanism with a portion of the double lock assembly removed, and generally showing the mechanism in the unlatched, unlocked and un-double locked state.
Figure 4B:
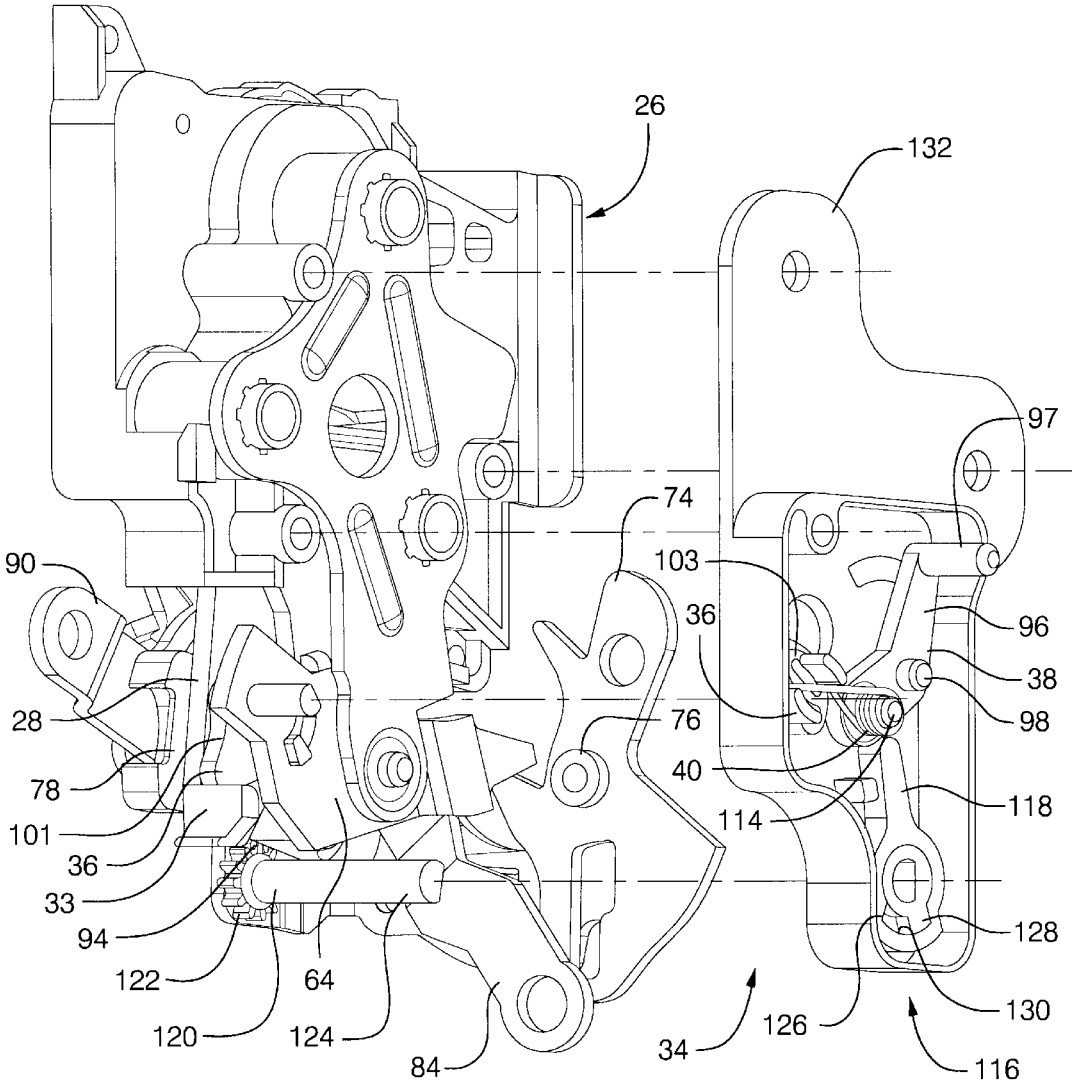
FIG. 4B is a rear perspective view of the latch mechanism with a portion of the double lock assembly removed, and generally showing the mechanism in the unlatched, unlocked and un-double locked state.

In FIGS. 4A and 4B the latch mechanism 10 is shown in its unlatching state. The transfer lever 64 of the latch handle assembly moves down in response to operation of the inside latch handle 14 or the outside latch handle 18. When the transfer lever 64 moves down—i.e. counterclockwise—it draws the secondary intermittent member 36 down also, so that the extendible end 101 abuts the projection 33 of the intermittent member 28. This forces the intermittent member 28 down, causing the latch assembly 26 to release the striker 27.

Figure 5A:
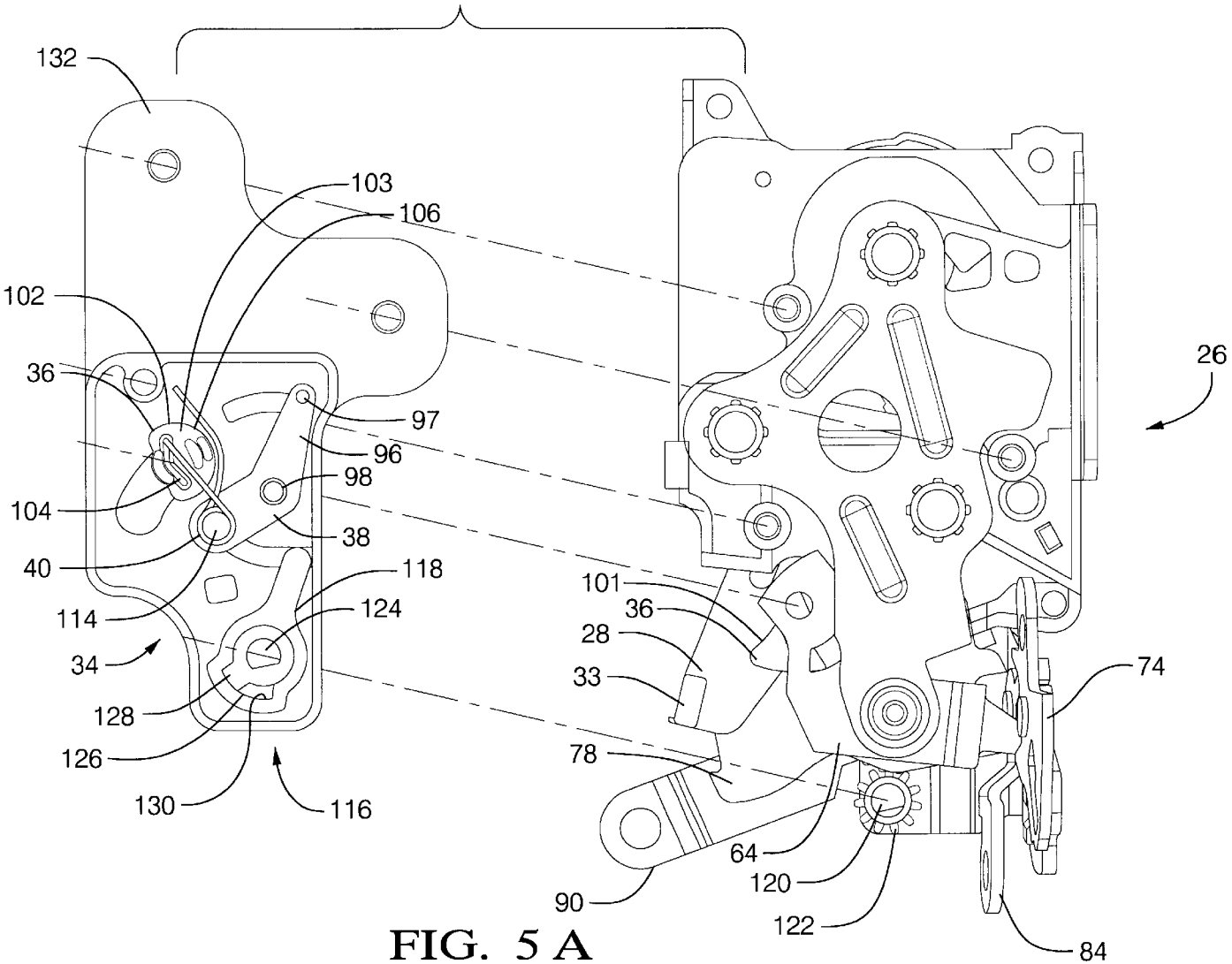
FIG. 5A is a rear view of the latch mechanism with a portion of the double lock assembly removed, and generally showing the mechanism in the latched, locked and un-double locked state.
Figure 5B:
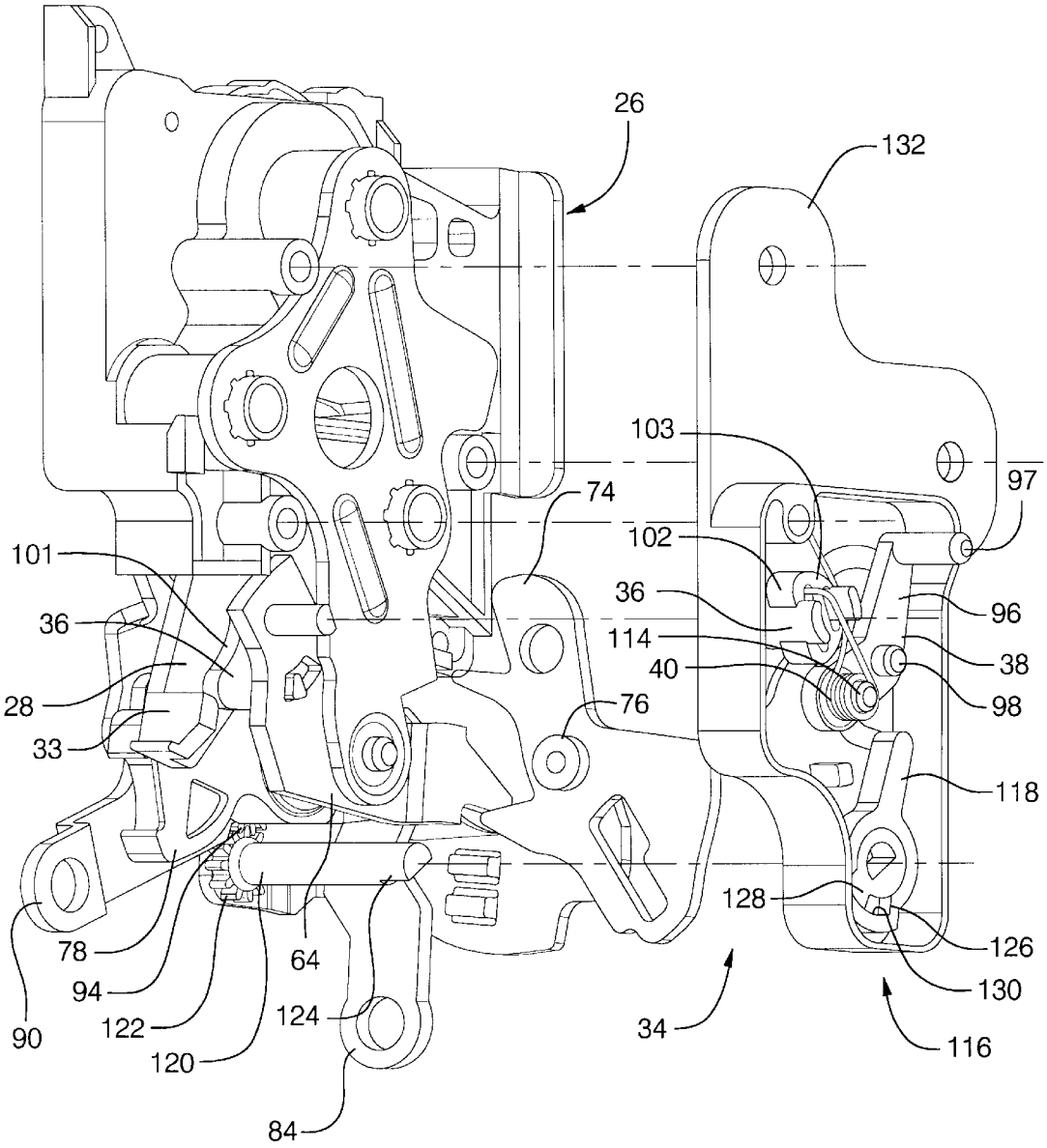
FIG. 5B is a rear perspective view of the latch mechanism with a portion of the double lock assembly removed, and generally showing the mechanism in the latched, locked and un-double locked state.

In FIGS. 5A and 5B the latch mechanism 10 is shown in the latched, locked and un-double locked state. Here, the locking lever 78 rotates down, or counterclockwise in the FIGS., in response to operation of the inside lock button 16, the key lock cylinder 20 or the key fob 22. When the locking lever 78 rotates down, it rotates the intermittent member 28 up, or clockwise in the FIGS. As shown in the FIGS., this moves the projection 33 on the intermittent member 28 out so that the secondary intermittent member 36 cannot contact the projection 33 even when the secondary intermittent member is in the extended position. This prevents motion transfer to the latch assembly 26, preventing any unlatching.

Figure 6A:
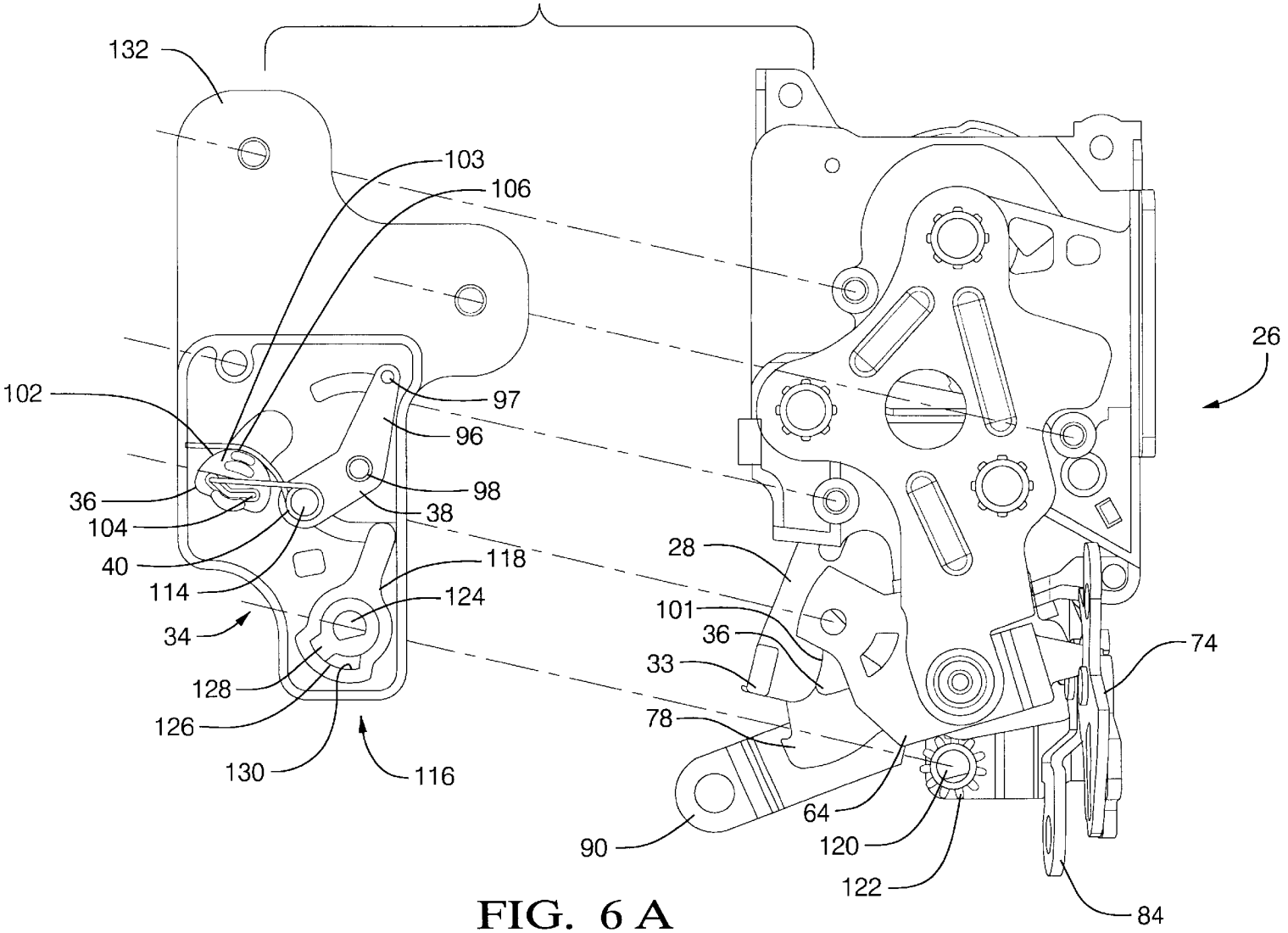
FIG. 6A is a rear view of the latch mechanism with a portion of the double lock assembly removed, and generally showing the mechanism in the unlatched, locked and un-double locked state.
Figure 6B:
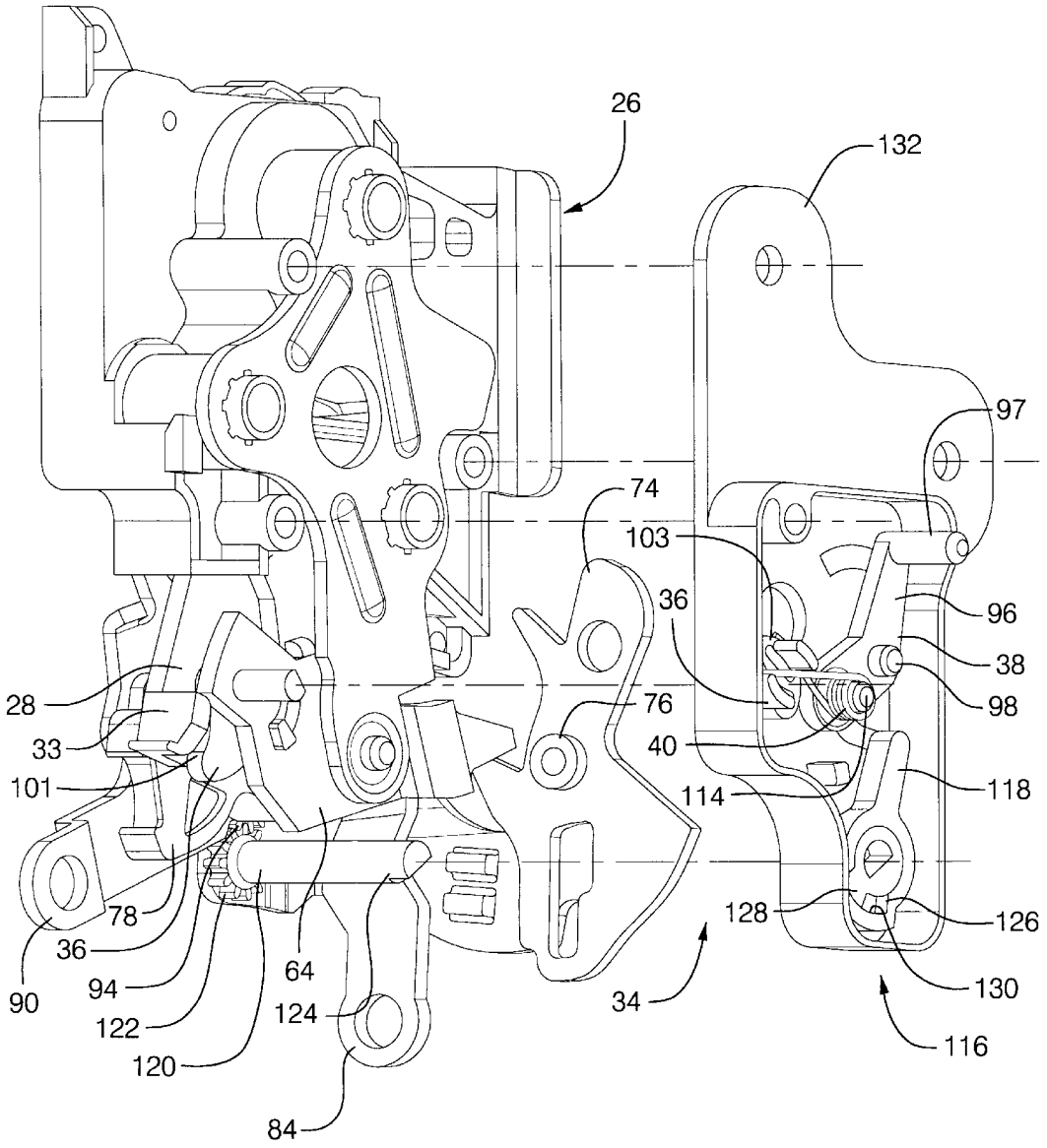
FIG. 6B is a rear perspective view of the latch mechanism with a portion of the double lock assembly removed, and generally showing the mechanism in the unlatched, locked and un-double locked state.

In FIGS. 6A and 6B the latch mechanism 10 is shown in the unlatching state. Because the latch 10 is locked as described above, with the intermittent member 28 pushed out of the path of the transfer lever 64 and the secondary intermittent member 36, the secondary intermittent member 36 simply bypasses the intermittent member without any contact—even when the secondary intermittent member 36 is extended as shown.

Figure 7A:
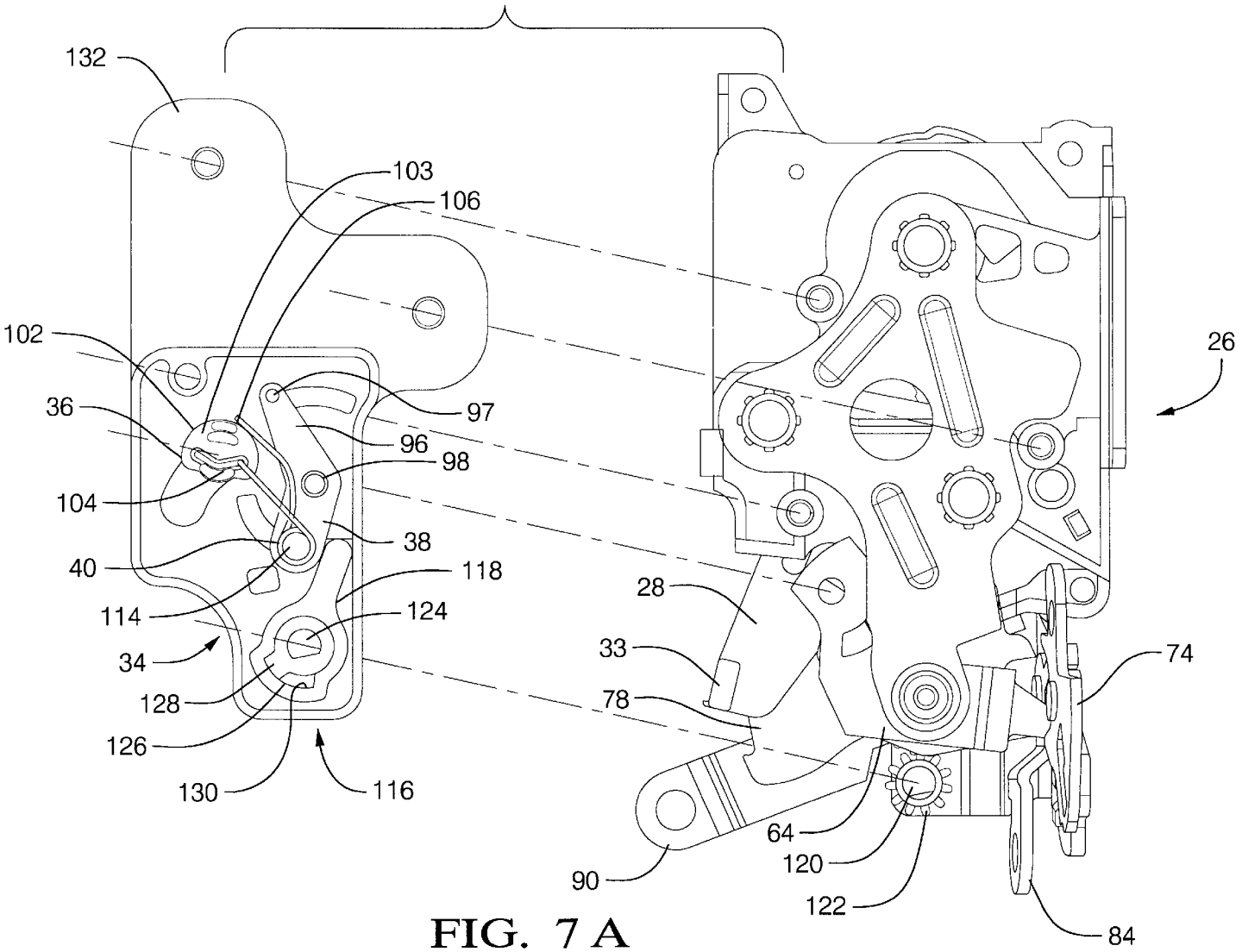
FIG. 7A is a rear view of the latch mechanism with a portion of the double lock assembly removed, and generally showing the mechanism in the latched, locked and double locked state.
Figure 7B:
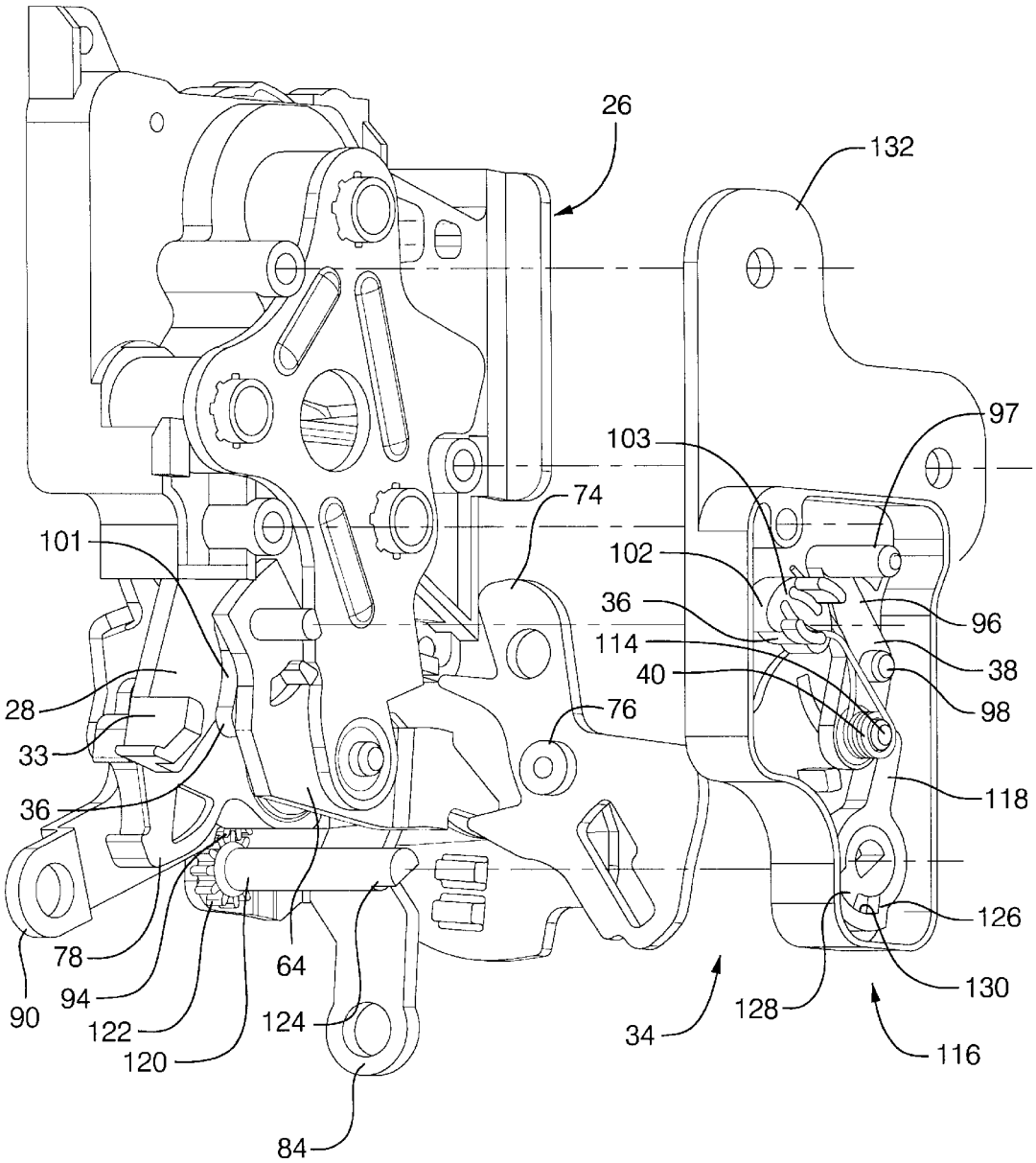
FIG. 7B is a rear perspective view of the latch mechanism with a portion of the double lock assembly removed, and generally showing the mechanism in the latched, locked and double locked state.

In FIGS. 7A and 7B the latch mechanism 10 is shown in the latched, locked, and double locked state. Here, the switch 38 is in the switched position. The switch 38 moves into this position by pressing a double lock button on the key fob 22, or by operating some other remote control including an electrical switch on or near the key lock cylinder 20. Such remote control actuates the electromechanical actuator 100, which in turn moves the extension pin 97 on the switch arm 96. When the switch arm 96 moves into the switched position (counterclockwise in the FIGS.), the spring 40 rotates the secondary intermittent member 36 in the counterclockwise direction (as shown in the FIGS.) to move the secondary intermittent member into the double locked position where the extendible end 101 of the secondary intermittent member 36 is fully retracted.

Figure 8A:
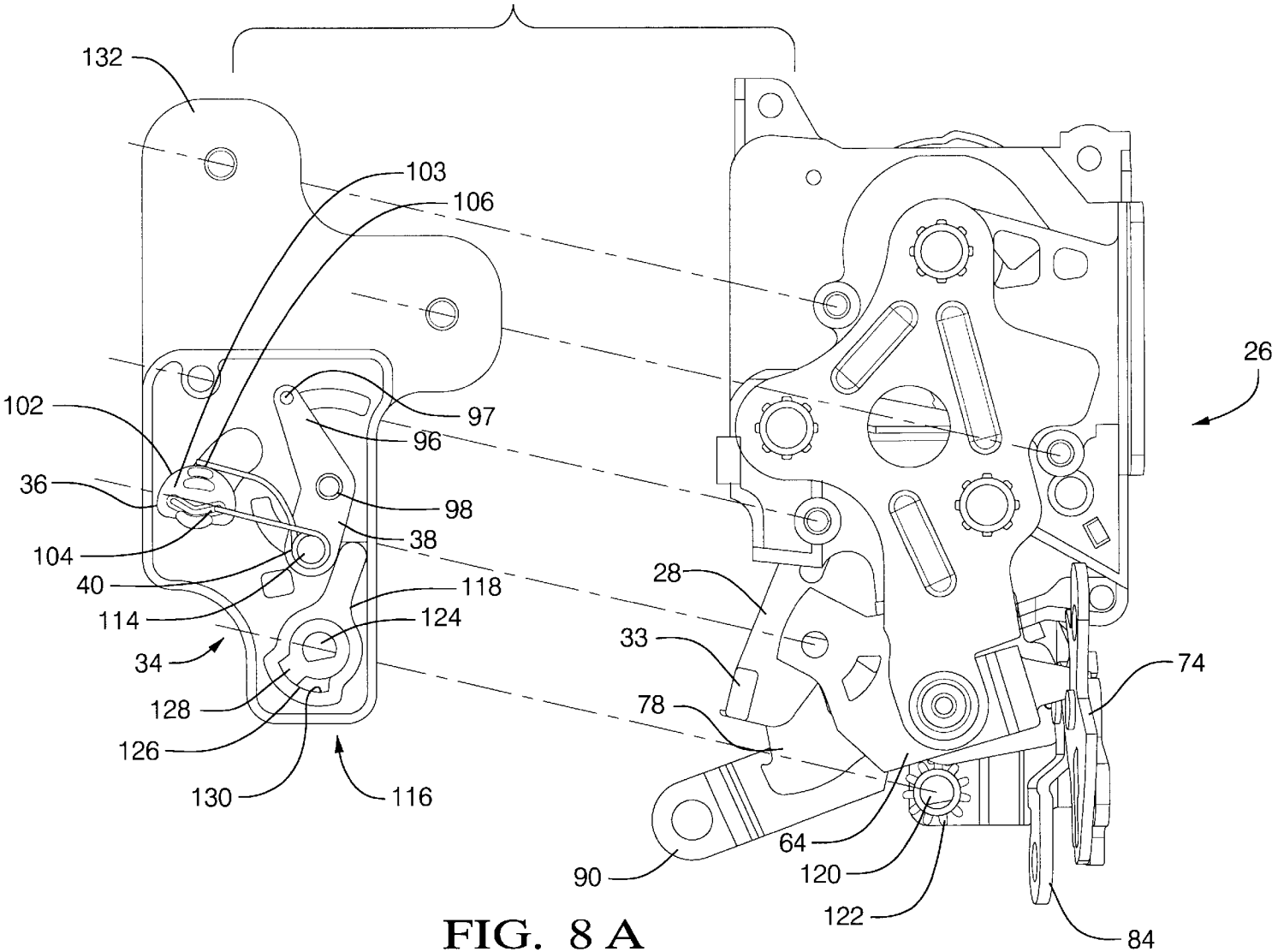
FIG. 8A is a rear view of the latch mechanism with a portion of the double lock assembly removed, and generally showing the mechanism in the unlatched, locked and double locked state.
Figure 8B:
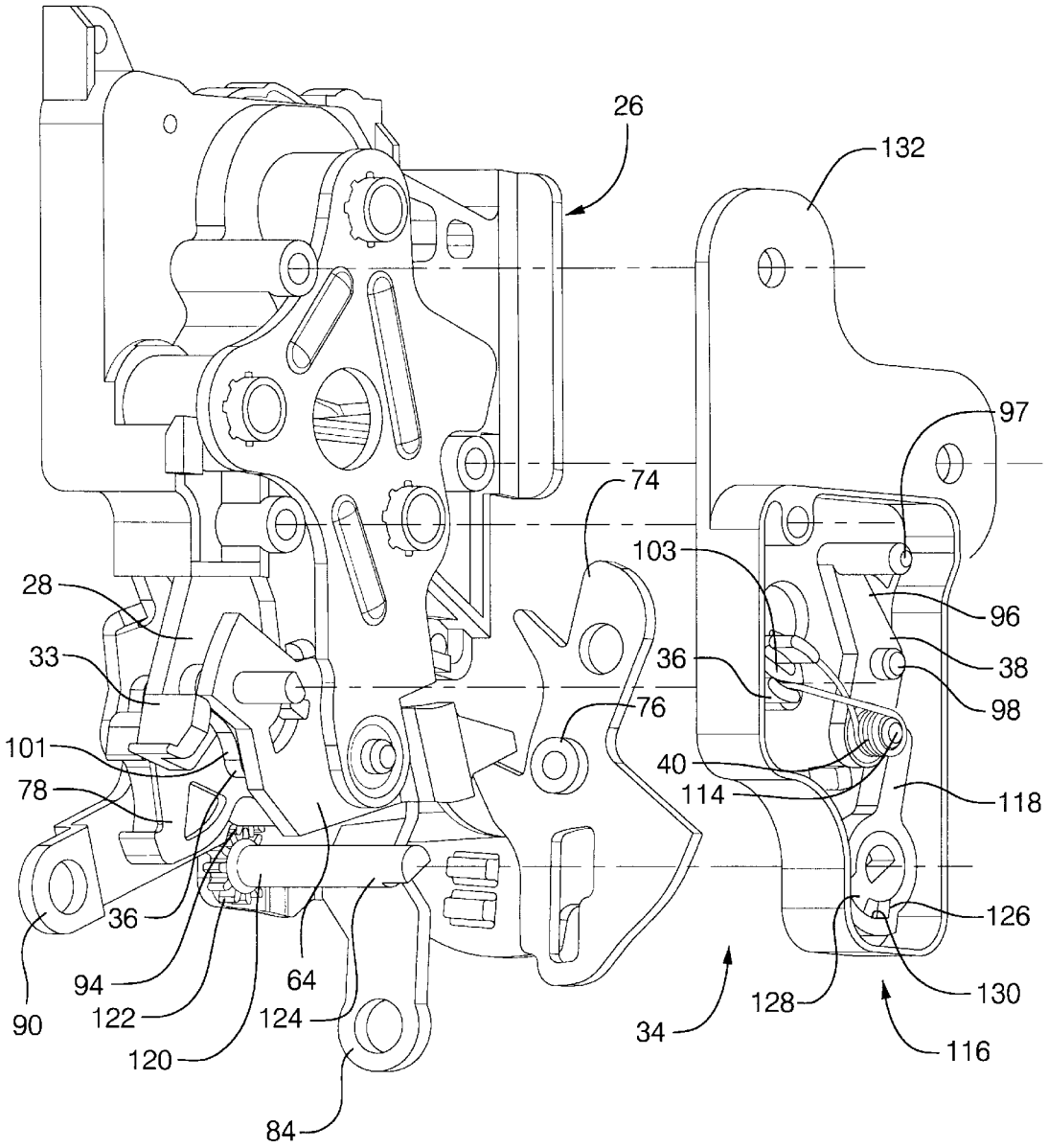
FIG. 8B is a rear perspective view of the latch mechanism with a portion of the double lock assembly removed, and generally showing the mechanism in the unlatched, locked and double locked state.

FIGS. 8A and 8B show the latch 10 in the locked, double locked and unlatching states. This shows that there is no motion transfer between the secondary intermittent member 36 and the intermittent member 28 because the extendible end 101 of the secondary intermittent member 36 is retracted and because the intermittent member 28 is pushed out to the locked position.

Figure 9A:
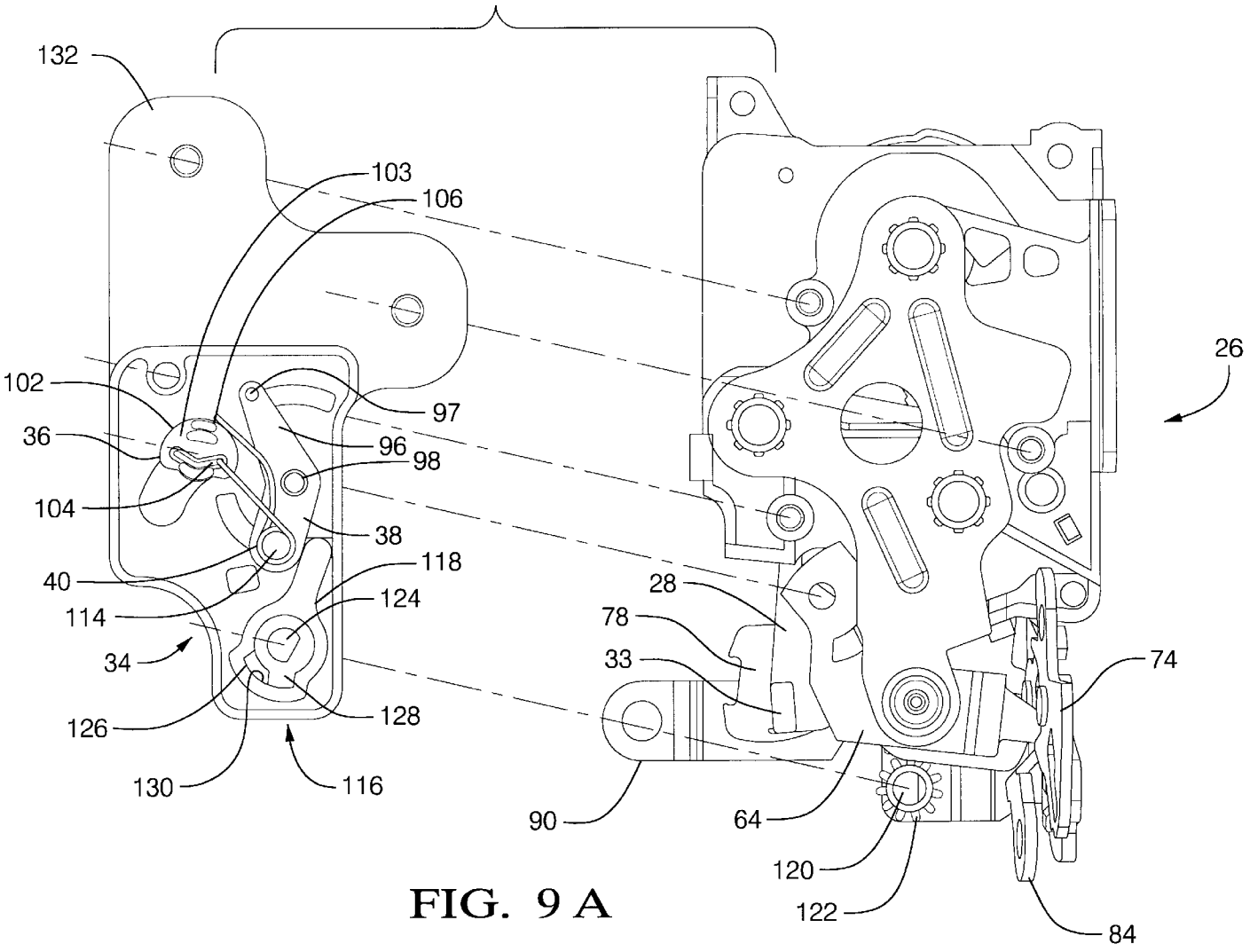
FIG. 9A is a rear view of the latch mechanism with a portion of the double lock assembly removed, and generally showing the mechanism in the latched, unlocked and double locked state.
Figure 9B:
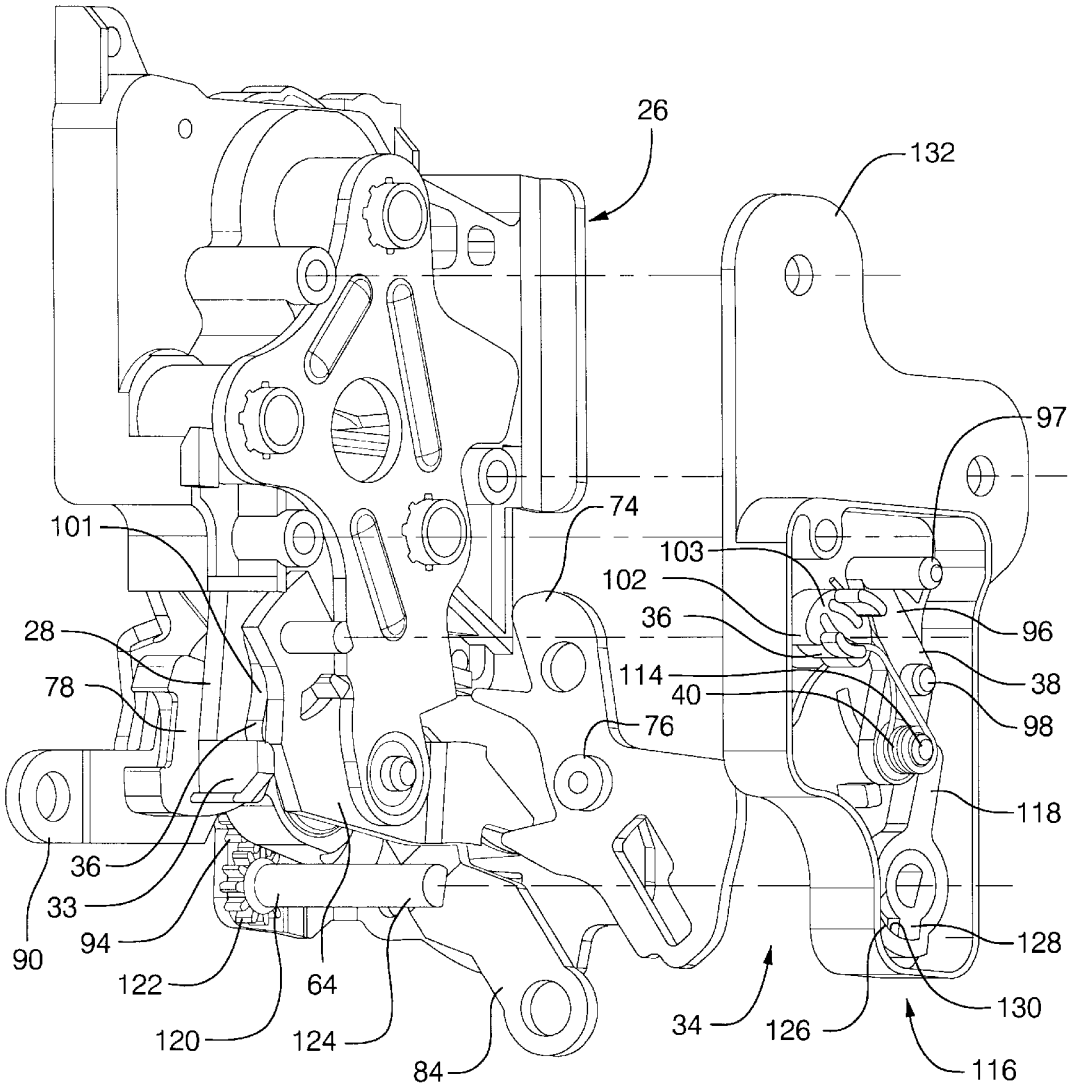
FIG. 9B is a rear perspective view of the latch mechanism with a portion of the double lock assembly removed, and generally showing the mechanism in the latched, unlocked and double locked state.

FIGS. 9A and 9B show the latch 10 in the latched, unlocked and double locked state. Here, the intermittent member 28 is back in the unlocked condition, i.e. it has rotated counterclockwise as shown in the FIGS. However, FIGS. 10A and B show the unlatching state. One can see that no motion passes from the secondary intermittent member 36 to the intermittent member 28—even when the intermittent member 28 is in the unlocked position—because the secondary intermittent member 36 is in the double locked position, retracted away from the intermittent member.

Figure 10A:
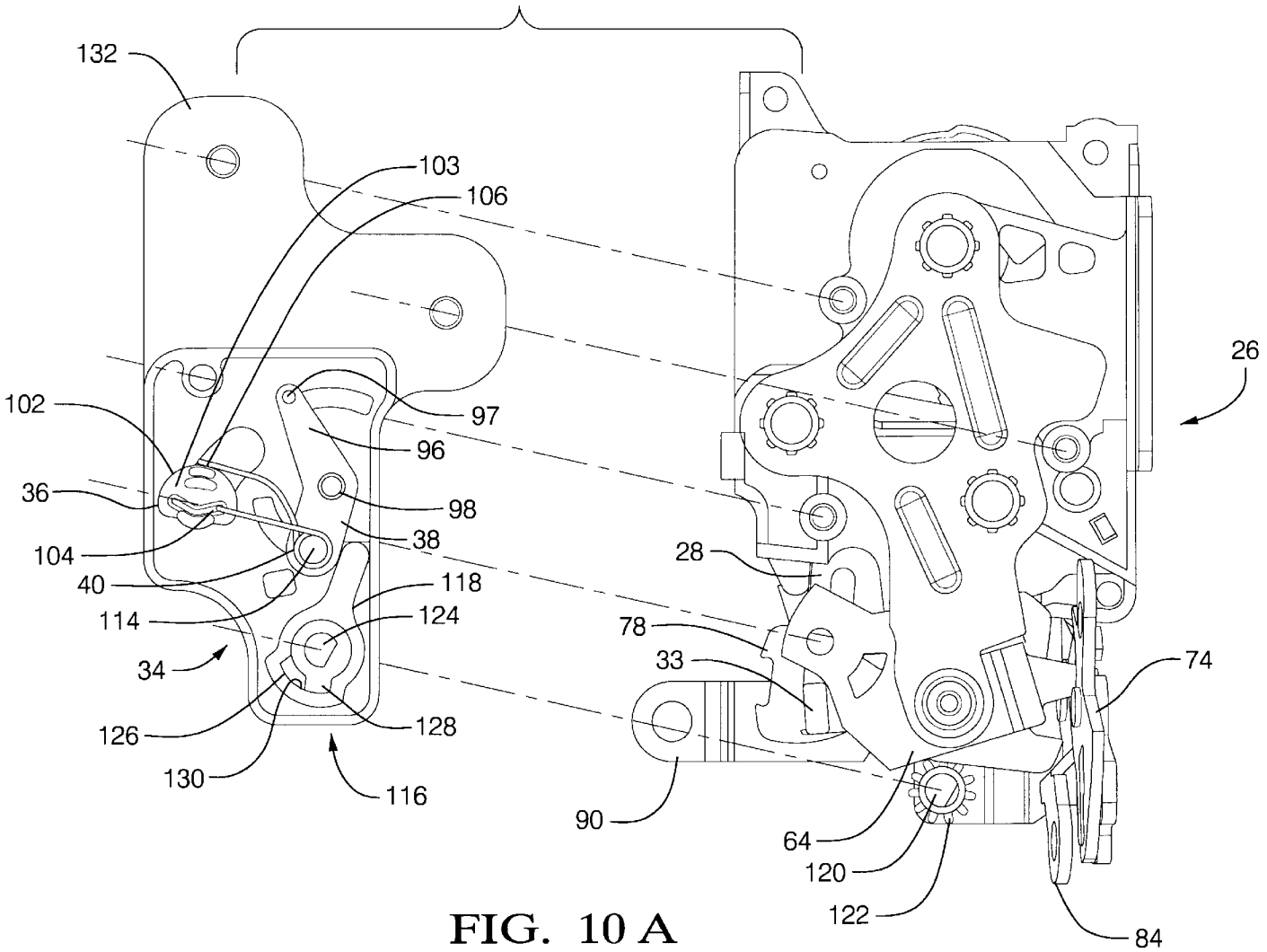
FIG. 10A is a rear view of the latch mechanism with a portion of the double lock assembly removed, and generally showing the mechanism in the unlatched, unlocked and double locked state.
Figure 10B:
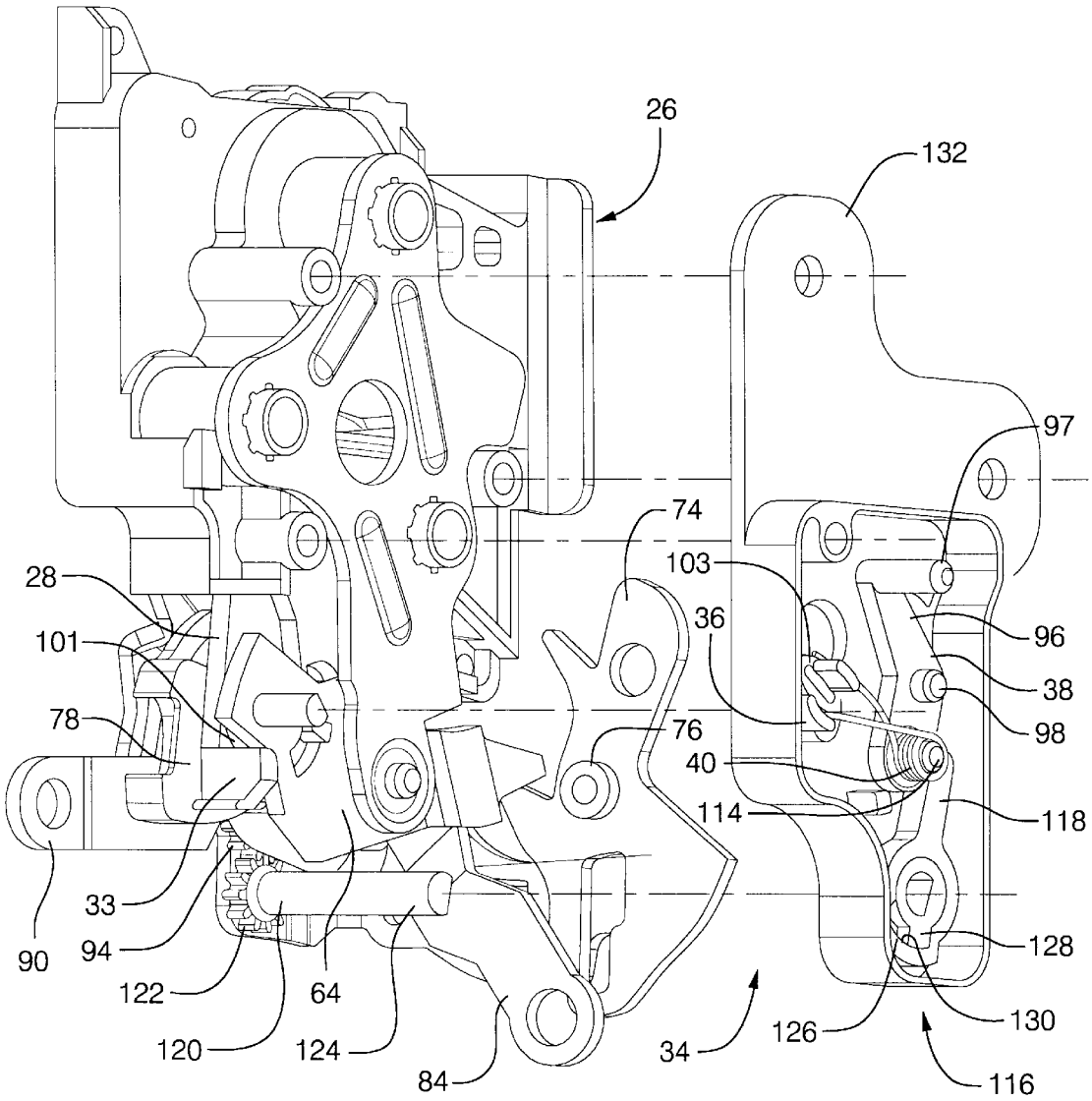
FIG. 10B is a rear perspective view of the latch mechanism with a portion of the double lock assembly removed, and generally showing the mechanism in the unlatched, unlocked and double locked state.

The spring 40 provides an important benefit. It allows a person to un-double lock the latch 10 even when the latch is in a locked or unlatching state. No special sequencing of operations is necessary. For example, if a person un-double locks the latch 10 while the latch is unlocked and in the unlatching state, as shown in FIGS. 10A and 10B, the spring will force the secondary intermittent member 36 to rotate into the un-double locked position as soon as the latch moves back to the latched position (see FIGS. 3A and 3B)—as in the case where an impatient passenger lets go of the latch handle 18.

As mentioned above, the double lock assembly 34 includes an override assembly 116. In operation, the double lock assembly 34 can be overridden manually by operating the key lock cylinder 20. When a key is inserted therein and rotated a predetermined distance, the key cylinder lever 90 will move up or counterclockwise as shown in FIGS. 7 through 10. This movement will translate motion via the gear teeth 94 to the gear teeth 122 on the override gear 120. The shaft 124 will then rotate, resulting in counterclockwise movement of the tab 128. If the key cylinder lever 90 is rotated only partially, the tab 128 may not transfer any motion to the override lever 118 because of the lost motion connection 126 including the arcuate slot 136. But if the key cylinder lever moves through its full rotation, the tab 128 will move the override lever 118 counterclockwise, which in turn rotates the switch arm 96 clockwise into the unswitched position shown in FIGS. 3A and 3B to un-double lock the door.

The invention has been described in an illustrative manner, and it is to be understood that the terminology which has been used is intended to be in the nature of words of description rather than of limitation.

Obviously, many modifications and variations of the present invention are possible in light of the above teachings. Therefore, it is to be understood that within the scope of the appended claims the invention may be practiced otherwise than as specifically described. Moreover, the reference numerals are merely for convenience and are not intended to be in any way limiting.

We claim:

1. A door latch mechanism having a double lock comprising:

an enclosure;

a latching assembly disposed in said enclosure and moveable between an unlatched configuration and a latched configuration;

an intermittent member engaging said latching assembly and moveable from a rest position to an unlatched position in which said intermittent member moves said latching assembly into said unlatched configuration;

a latch handle assembly disposed adjacent said intermittent member and moveable from a rest position to an unlatching position to engage said intermittent member and move said intermittent member to said unlatched position;

a lock assembly disposed in said enclosure and engaging said intermittent member, said lock assembly being moveable between an unlocked position in which said lock assembly positions said intermittent member so that said intermittent member engages said latch handle assembly when said latch handle assembly moves toward said unlatching position, and a locked position in which said lock assembly isolates said intermittent member from said latch handle assembly;

a double lock assembly including a secondary intermittent member connected to said latch handle assembly and moveable between an un-double locked position in which said secondary intermittent member extends outwardly from said latch handle assembly to allow motion transfer between said latch handle assembly and said intermittent member, and a double locked position in which said secondary intermittent member retracts to prohibit any motion transfer between said latch handle assembly and said intermittent member;

said double lock assembly including a switch disposed adjacent said secondary intermittent member, said switch being moveable between an unswitched position and a switched position wherein said switch moves said secondary intermittent member into said double locked position;

said double lock assembly including a spring disposed between said switch and said secondary intermittent member biasing said secondary intermittent member into said un-double locked position when said switch moves into said unswitched position, and into said double-locked position when said switch moves into said switched position.

2. The door latch mechanism of claim 1 wherein said secondary intermittent member includes an extendible end disposed adjacent said latch handle assembly and a remote spring end disposed adjacent said spring, said spring end having a top surface defining an arcuate slot and a side surface adjacent said top surface.

3. The door latch mechanism of claim 2 wherein said spring includes a first arm and a second arm extending parallel to said first arm, said spring being coiled between said first and second arms.

4. The door latch mechanism of claim 3 wherein said coil of said spring contacts said switch, said first arm of said spring contacts said arcuate slot, and said second arm of said spring contacts said side surface.

5. The door latch mechanism of claim 1 wherein said lock assembly further includes a key cylinder lever.

6. The door latch mechanism of claim 5 wherein said double lock assembly further includes a manual override assembly disposed between said switch and said key cylinder lever, said manual override being movable between a neutral position and an override position in which said override assembly moves said switch into said unswitched position.

7. The door latch mechanism of claim 6 wherein said manual override assembly further includes an override lever disposed adjacent said switch.

8. The door latch mechanism of claim 7 wherein said manual override assembly further includes an override gear disposed between said key cylinder lever and said override lever.

9. The door latch mechanism of claim 8 wherein said manual override assembly further includes a lost motion connection between said override gear and said override lever.

10. The door latch mechanism of claim 8 wherein said manual override assembly further includes a plurality of gear teeth disposed on said key cylinder lever in contact with said override gear.

11. The door latch mechanism of claim 6 wherein said manual override assembly further includes an enclosure.

12. A door latch mechanism having a double lock comprising:

an enclosure;

a latching assembly disposed in said enclosure and moveable between an unlatched configuration and a latched configuration;

an intermittent member engaging said latching assembly and moveable from a rest position to an unlatched position in which said intermittent member moves said latching assembly into said unlatched configuration;

a latch handle assembly disposed adjacent said intermittent member and moveable from a rest position to an unlatching position to engage said intermittent member and move said intermittent member to said unlatched position;

a lock assembly disposed in said enclosure and engaging said intermittent member, said lock assembly being moveable between an unlocked position in which said lock assembly positions said intermittent member so that said intermittent member engages said latch handle assembly when said latch handle assembly moves toward said unlatching position, and a locked position in which said lock assembly isolates said intermittent member from said latch handle assembly;

a free-wheeling double lock assembly including a secondary intermittent member connected to said latch handle assembly and moveable between an un-double locked position in which said secondary intermittent member extends outwardly from said latch handle assembly to allow motion transfer between said latch handle assembly and said intermittent member, and a double locked position in which said secondary intermittent member retracts to prohibit any motion transfer between said latch handle assembly and said intermittent member;

said free-wheeling double lock assembly including a switch disposed adjacent said secondary intermittent member, said switch being moveable between an unswitched position and a switched position wherein said switch moves said secondary intermittent member into said double locked position.

* * * * *